United States Patent [19]

Lucas

[11] Patent Number: 4,811,010

[45] Date of Patent: Mar. 7, 1989

[54] MONITOR SYSTEM FOR TRAFFIC-LIGHTS

[75] Inventor: Ian R. Lucas, St. Ives, Australia

[73] Assignee: U.S. Philips Corp., New York, N.Y.

[21] Appl. No.: 903,004

[22] Filed: Sep. 2, 1986

[30] Foreign Application Priority Data

Sep. 5, 1985 [AU] Australia ..... PH 02298

[51] Int. Cl.[4] ..... G08B 21/00

[52] U.S. Cl. ..... 340/642; 340/931; 307/38

[58] Field of Search ..... 340/931, 912, 913, 916, 340/641, 642; 324/76 R, 98; 200/42.01, 318; 307/11, 30, 33, 356, 358, 362, 35, 38, 39

[56] References Cited

U.S. PATENT DOCUMENTS

| | | | |
|---|---|---|---|
| 3,648,233 | 3/1972 | Clark | 340/931 |
| 4,091,381 | 5/1978 | Huntsinger | 324/98 |
| 4,494,010 | 1/1985 | Donnelly | 307/33 |

*Primary Examiner*—Joseph A. Orsino
*Assistant Examiner*—Jill D. Jackson
*Attorney, Agent, or Firm*—Bernard Franzblau

[57] ABSTRACT

A monitor circuit arrangement for traffic lights wherein energy is supplied from an alternating voltage supply source(s) to a lamp (L 1) via a controlled switch (SD 1) and energization of the unit is monitored by a voltage comparator connected in cascade with a sensing latch (SL 1). The output of the voltage comparator is activated in response to its input voltage exceeding a predetermined magnitude of either polarity relative to a common reference voltage wave. A monitored voltage representative of the voltage present across the lamp is supplied as an input voltage to the voltage comparator, the output of which is fed to the sensing latch set input. Reset means (RPS) are provided for resetting the latch at the commencement of each cycle of the alternating supply voltage.

18 Claims, 3 Drawing Sheets

MONITOR SYSTEM FOR TRAFFIC-LIGHTS

BACKGROUND OF THE INVENTION

The present invention relates to monitor circuit arrangements for monitoring the energization of an energizable unit connected for controlled switching of energy supplied from an alternating voltage supply source.

A plurality of circuit arrangements of the kind to which the invention relates may be employed in a conflict monitor system for monitoring the alternating voltage mains supply energization of individual lamps or groups of lamps of a traffic signal system. In such an arrangement, energy is supplied to the lamps via controlled switching devices. If such a switching device is faulty, it is possible for the switching device to function as a half-wave rectifier. A signal lamp will still glow if energized by half-wave rectified current and it is therefore desirable for a conflict monitor to indicate energization of two lamps under conditions when the respective lamps are supplied with current on alternate half-cycles of the supply and supplied in anti-phase with each other so that consequently a voltage is not present across both lamps simultaneously. In contrast to the foregoing, in circumstances when the level of energization of a lamp is insufficient for the lamp to glow, it is undesirable to provide an indication of energization even though a voltage is present across the lamp.

SUMMARY OF THE INVENTION

In a monitor circuit arrangement in accordance with the present invention, energy is supplied from an alternating voltage supply source to an energizable unit via a controlled switching device and energization of the unit is monitored by a voltage comparator connected in cascade with a sensing latch. The voltage comparator is arranged so that its output is activated in response to its input voltage exceeding a predetermined magnitude of either polarity relative to a common reference voltage wave. A monitored voltage representative of the voltage present across the energizable unit is supplied as an input voltage to the voltage comparator, the output of which is fed to the sensing latch set input. Reset means are provided for resetting the latch at the commencement of each cycle of the alternating supply voltage.

The term "latch" refers to a device with an output having either an active state or an inactive state, a set input and a reset input wherein with the output in the active state the state of the output is not affected by the state of the set input but is changed to the inactive state by activation of the reset input, whereas with the output in the inactive state the state of the output is not affected by the state of the reset input but is changed to the active state by activation of the set input.

In a monitor circuit arrangement in accordance with the invention, the said sensing latch is set to the active output for the remainder of the cycle if at any time during a cycle of the supply a voltage of sufficient magnitude of either polarity is present across the energizable unit associated with the latch.

In one form of the invention the said common reference voltage wave is a first alternating reference voltage having a magnitude proportional in a given ratio to that of the supply source voltage and the said monitored voltage is a derived voltage having a magnitude proportional in a similar given ratio to that of the difference between the supply source voltage and the voltage across the energizable unit. In this form of the invention, the said voltage comparator is preferably in the form of first and second differential comparators in combination, the output of the two differential comparators being connected to function as the voltage comparator output. The positive input of the first differential comparator is connected to a second reference source supplying a second reference voltage exceeding the said first alternating reference voltage by the said predetermined magnitude. The negative input of the second differential comparator is connected to a third reference source supplying a third reference voltage less than the said first alternating reference voltage by the said predetermined magnitude and the negative input of the first differential comparator being connected to the positive input of the second differential comparator to form the voltage comparator input.

It is advantageous for a plurality of circuit arrangements each in accordance with the invention to be utilized in combination with a conflict detection means provided with a set of input terminals respectively connected via individual monitor paths to monitor individual energizable units or groups of energizable units so that respective input terminals of the set are activated in response to energization of respective individual units or groups of units. Individual monitor paths include a circuit arrangement in accordance with the invention and the conflict detection means generate conflict signifying information at an output thereof in response to simultaneous activation of predetermined combinations of input terminals of the set. When utilized in such a combination, it is advantageous for the conflict detection means to be followed by an information processing stage which processes conflict signifying information produced at the conflict detection means output so as to eliminate interruptions arising from reset of the sensing latches. For this purpose, the output of the conflict detection means may be supplied to the set input of a further latch via an integrating network, the reset input of the further latch being activated at the commencement of each cycle of the supply by a reset pulse. The time constant of the integrating network is long relative to the duration of the reset pulse whereby the latch is only reset by a reset pulse if no conflict signifying information is present at its input at the time of the reset pulse. The signal indicating a conflict condition may be derived from the output of the further latch.

In this way, the further latch functions as a so-called stretching latch. The applicant's copending U.S. patent application Ser. No. 903,043 describes the operation of a stretching latch for a related purpose.

Such an information processing stage may take any one of a variety of other forms and the particular form taken will depend upon the desired performance of the overall system in which the circuit arrangement according to the invention is employed. In some systems a network comprising a series resistance and a parallel capacitance and having a large time constant relative to interruptions due to reset of the sensing latches will adequately serve as an information processing stage. In other systems a resettable latch, the data input of which is connected to the conflict detection means output and which is reset synchronously but not simultaneously with reset of the sensing latches may be appropriate.

BRIEF DESCRIPTION OF THE DRAWING

The invention will now be described in greater detail with reference to the accompanying drawings in which.

DESCRIPTION OF THE PREFERRED EMBODIMENTS

Figure 1:
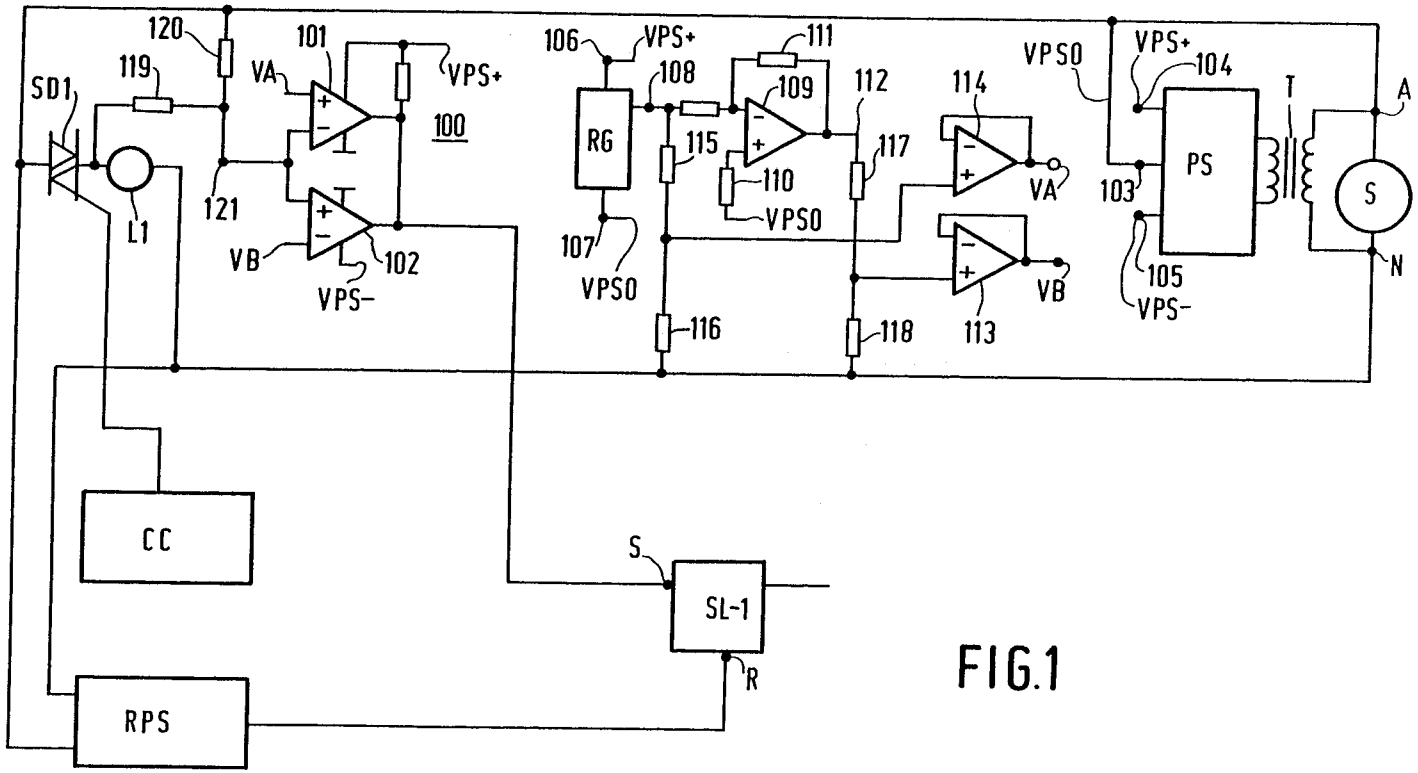
FIG. 1 is a diagram, partly in block form, showing a monitor circuit arrangement in accordance with the invention in combination with a reference voltage generator therefor.

In the circuit arrangement of FIG. 1, a 50 cycles per second alternating mains voltage supply source S having an active terminal A and a neutral terminal N supplies voltage to a lamp L1 in series with a controlled semiconductor switching device SD1 in the form of a triac. The conductivity of the switching device SD is controlled by means of a control circuit CC which forms no part of the present invention. However, owing to the possibility of a malfunction of the control circuit CC or of the switching device SD, it is desirable to monitor the voltage developed across the lamp L1.

A monitor circuit for monitoring the voltage present across the lamp L1 is constituted by a voltage comparator 100 in cascade with a sensing latch SL1. The voltage comparator 100 is formed by a pair of differential comparators 101 and 102 connected in the manner described herein, two of the comparators of an integrated circuit type LM339 being utilized, in this instance, to form the differential comparators 101 and 102. The negative input of the differential comparator 101 and the positive input of the differential comparator 102 are connected together and to the junction of the switching device SD1 and the lamp L1 by means of a voltage divider 119–120. The positive input of the differential comparator 101 is connected to one reference voltage source, the negative input of the differential comparator 102 is connected to a different reference voltage source and the output of the differential comparators 101 and 102 are connected together and to the set or data input of the sensing latch SL1. The sensing latch SL1, in this instance, is formed by one of the latches of an integrated circuit type 4043.

The characteristics of a latch of an integrated circuit type 4043 is depicted by the truth table set out below as Table 1.

TABLE 1

| S | R | Qn |
|---|---|---|
| 0 | 0 | Q(n-1) |
| 1 | 0 | 1 |
| 0 | 1 | 0 |
| 1 | 1 | 1 |

In the Table 1:

The column S denotes the binary signal "0" or "1" at the set input of the latch.

The column R denotes the binary signal "0" or "1" at the reset input of the latch.

The column Qn denotes the resultant signal produced at the output of the latch at the instant n.

The term Q(n−1) denotes the signal at the output of the latch at the instant immediately preceding the instant n.

The operating supply voltages specified for a semiconductor differential comparator such as those forming part of an integrated circuit type LM339 is typically a direct voltage not greater than around 20 volts DC. The purpose of the differential comparators 101 and 102 is to determine whether or not the voltage present across the lamp L1 exceeds a given threshold in either the positive or negative direction. However, since the voltages developed across the lamp L1 are considerably larger than the specificed DC supply voltages of the differential comparators, it is necessary to provide an interface between the voltage under comparison, i.e. the voltage developed across the lamp L1, and the differential comparators 101 and 102 which is satisfactory to their operating voltage levels and simultaneously to provide reference voltage sources valid for comparison purposes by the comparators 101 and 102.

The operating supply voltages for the differential comparators 101 and 102 are provided by a power supply arrangement PS coupled to the mains supply source S by a mains transformer T. The power supply arrangement PS produces DC voltages for supply purposes and has three output terminals, a common output terminal 103 directly connected to the active terminal A, a positive output terminal 104 and a negative output terminal 105.

At the output terminal 104 a DC voltage VPS+ is produced which is positive relative to the common terminal 103 and at the output terminal 105 a DC voltage VPS− is produced which is negative relative to the common terminal 103, the voltage VPS+ being of equal magnitude but of opposite polarity to the voltage VPS− and the potential of the terminal 103 being denoted as VPS0. The power supply arrangement PS is of known kind.

A DC reference voltage generator RG is provided for generating a stabilised DC voltage of predetermined magnitude at its output. The input supply terminals 106 and 107 of the voltage generator RG are respectively connected to the terminals 104 and 103 of the power supply arrangement PS. The output voltage of the generator RG is produced at an output terminal 108 and has a magnitude VREF positive relative to the terminal 107. The reference voltage generator RG is of known kind.

The output terminal 108 of the generator RG is connected to the negative input of an operational amplifier 109, the positive input of which is connected via a resistance 110 to the terminal 103 of the power supply PS. The output of the operational amplifier 109 is connected via a feedback resistance 111 to its negative input and the value of the resistance 111 has a value such that the amplifier 109 functions as a voltage inverter whereby, relative to the voltage VPSO, the potential of the common terminal 103, the voltage −VREF produced at the output terminal 112 is of equal and opposite polarity to the voltage produced at the terminal 108.

A further pair of operational amplifiers 113 and 114 are each connected to function as a unity gain buffer amplifier. For this purpose, the output of each amplifier is connected to its negative input. A voltage divider constituted by the series combination of resistances 115 and 116 is connected between the output terminal 108 and the neutral terminal N, with the junction of the resistances 115 and 116 connected to the positive input of the operational amplifier 114 to produce an alternating reference voltage VA at the output terminal of the amplifier 114. Likewise, a voltage divider constituted by the series combination of resistances 117 and 118 is connected between the output terminal 112 and the neutral terminal N with the junction of the resistances 117 and 118 connected to the positive input terminal of the operational amplifier 113 to produce an alternating reference voltage VB at the output terminal of the amplifier 113. The alternating reference voltage VA is applied to the positive input terminal of the differential amplifier 101 and the alternating reference voltage VB is applied to the negative input terminal of the differential amplifier 102.

The junction of the switching device SD1 with the lamp L1 is connected to the active terminal A via a voltage divider formed by the series combination of the resistances 119 and 120 with the junction of the resistances 119 and 120 connected to the input terminal 121 of the voltage comparator 100, which is common to the negative input of the differential amplifier 101 and the positive input of the differential amplifier 102. The ratio between the resistance values of the resistances 119 and 120 is the same as that between the resistances 116 and 115 and that between the resistances 118 and 117. Accordingly, the voltage applied to the input terminal 121 represents the monitored voltage scaled down in a given ratio whereas the reference voltages VA and VB are equal to the alternating source voltage scaled down in a similar given ratio to which a fixed positive voltage and a fixed negative voltage of equal and predetermined magnitude are respectively added.

From the foregoing it will be understood that in operation:

$$Va = \frac{Vn - Vact}{k} + Vref$$

and $$Vb = \frac{Vn - Vact}{k} - Vref$$

where Vn is the voltage of the neutral terminal N, Vact is the voltage of the active terminal A and k is the resistive division factor. The operation of the circuit arrangement of FIG. 1 is such that the output of the differential comparator 101 becomes active each time the voltage at the terminal 121 becomes more positive than the voltage Va and the output of the differential comparator 102 becomes active each time the voltage at the terminal 121 becomes more negative than the voltage Vb. Since the outputs of the differential comparators 101 and 102 are connected together, their common connection functions as a "wired or" circuit feeding the input of the sensing latch SL1.

The voltage at the junction of the switching device SD1 and the lamp L1 may be denoted as Vl. Accordingly, the voltage produced at the terminal 121 is $$\frac{Vl - Vact}{k}.$$

As indicated in the foregoing, if the voltage $$\frac{Vl - Vact}{k}$$

becomes more positive than the voltage Va or more negative than the voltage Vb then the output of the voltage comparator 100 is activated.

The voltage Vl−Vact is representative of the voltage across the lamp L1 since $Vl - Vact = (Vn - Vact) + (Vl - Vn)$, the voltage developed across the lamp L1 being Vl−Vn and the terminal voltage of the alternating voltage source S being Vn−Vact.

DC supply voltages for the differential comparators 101 and 102, for the operational amplifiers 109, 113 and 114, for the sensing latch SL1, for the control circuit CC and also for a source of reset pulses RPS may all be derived from the power supply arrangement PS. However, it is necessary for the reset pulse source RPS to be responsive also to the alternating supply voltage produced by the source S so that the source RPS produces reset pulses for resetting the latch SL1 at the commencement of each cycle of the alternating supply voltage.

Since the sensing latch SL1 is reset at the commencement of each cycle of the alternating supply, from the Table 1 it is seen that the output of the latch SL1 will remain inactive unless the output of the voltage comparator 100 is activated. However, should the output of the comparator 100 be activated during the course of any given cycle of the supply voltage then the output of the latch SL1 will also be activated and remain activated until the commencement of the next cycle of the supply irrespective of whether or not the output of the comparator 100 returns to an inactive state during the course of the given cycle.

Figure 2:
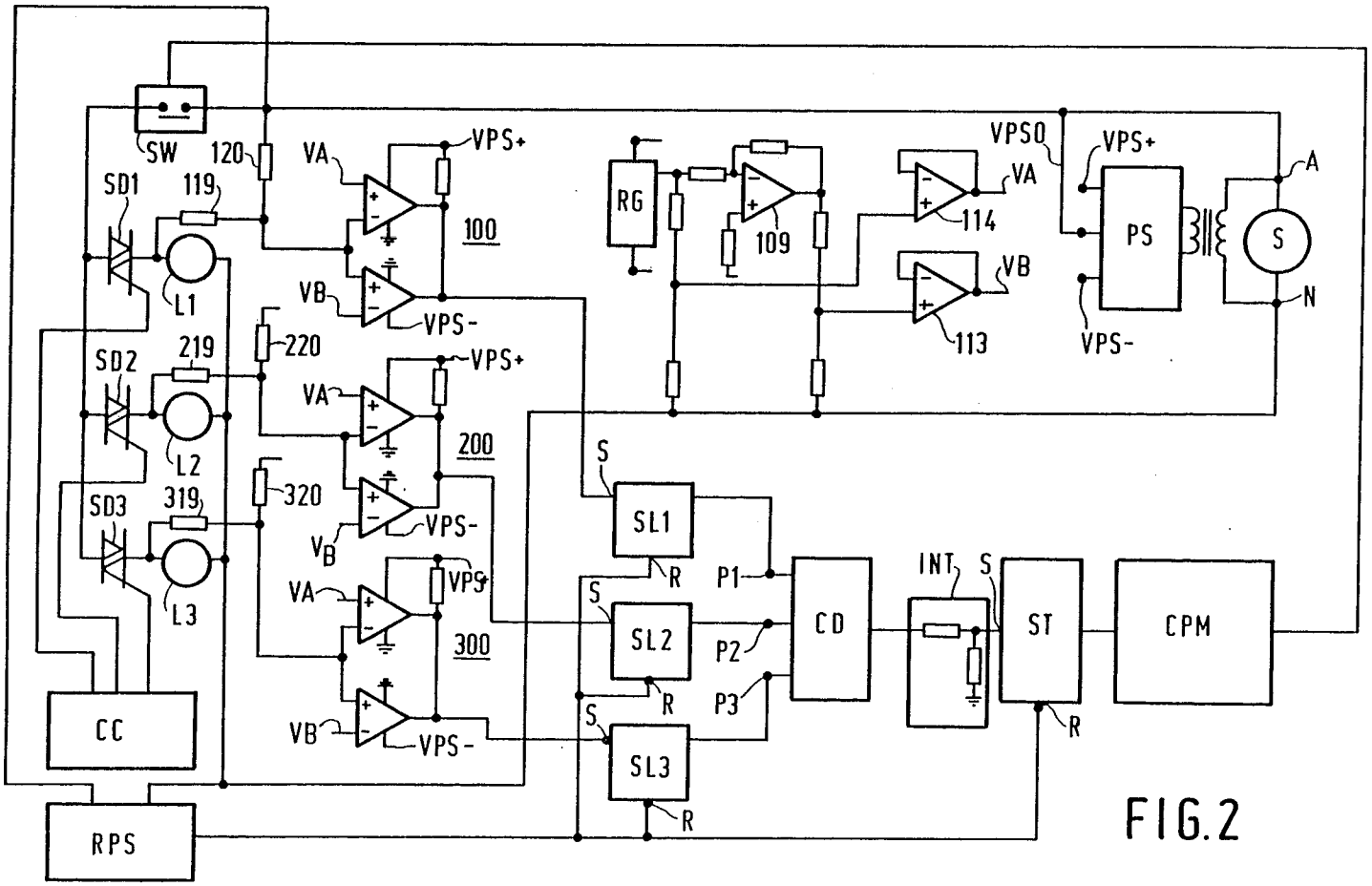
FIG. 2 is a diagram, partly in block form, of a traffic control system incorporating a conflict detection means and a plurality of monitor circuit arrangements in accordance with the invention.

In FIG. 2, there are three monitor circuit arrangements each similar to the monitor circuit arrangement of FIG. 1, each monitoring a different signal lamp and each serving as a monitor path supplying data to an input of a conflict detection means. The system of FIG. 2 operates in response to the conflict detection means so as to render the signal lamps inoperative if predetermined conflict conditions arise.

In FIG. 2, parts which are the same as those of FIG. 1 are denoted by the same letters or numerals.

In FIG. 2, in addition to the signal lamp L1 serially connected with the controlled switching device SD1 across the terminals A and N of the alternating voltage supply source S, there are signal lamps L2 and L3 connected across the terminals A and N via the controlled switching devices SD2 and SD3, respectively. The conductivity of the devices SD1, SD2 and SD3 are controlled independently of each other by the control circuit CC for the purpose of traffic control. Although the operation of the control circuit CC forms no part of the present invention, it will be understood that malfunction of either the control circuit CC or one or more of the switching devices SD1, SD2 or SD3 could result in unintentional simultaneous energization of two or more of the lamps L1, L2 and L3 sufficient for illumination of those particular signal lamps. In view of the danger of such a condition, the respective signal lamps and switching device combinations are connected in series with a relay switch SW to the source S. Disconnection of the lamps L1, L2 and L3 from the source S may be achieved by operation of the switch SW to open-circuit the switch contacts.

Associated with the lamp L2 is a voltage comparator 200 similar to the voltage comparator 100 and arranged in cascade with a sensing latch SL2 similar to the latch SL1. The junction of the lamp L2 and the device SD2 is connected via a voltage divider formed by the resistances 219 and 220 to the input of the voltage comparator 200. Likewise, associated with the signal lamp L3 is a voltage comparator 300 similar to the voltage comparator 100 and arranged in cascade with a sensing latch SL3 similar to the latch SL1. The junction of the lamp L3 and the device SD3 is connected via a voltage divider formed by resistances 319 and 320 to the input of the voltage comparator 300. The ratio between the resistance values of the resistances 219 and 220 and the ratio between the resistance values of the resistances 319 and 320 is the same as that between the resistances 119 and 120.

The reference voltages Va and Vb respectively produced at the output of the buffer amplifiers 113 and 114 are supplied to the voltage comparators 200 and 300 in a similar manner to the voltage comparator 100 as previously described in relation to FIG. 1. Accordingly, the cascade combination of the voltage comparator 200 and the sensing latch SL2 and also the cascade combination of the voltage comparator 300 and the sensing latch SL3 function in the same manner as the cascade combination of the voltage comparator 100 and the latch SL1, the reset input of the latches SL1, SL2 and SL3 each being connected to the reset pulse source RPS so that the three latches are simultaneously reset at the commencement of each cycle of the alternating supply voltage of the source S.

In operation and with the contacts of the relay switch SW closed so that one or more of the lamps L1, L2 and L3 may be energized under the control of the control circuit CC, the information produced at the respective outputs of the latches SL1, SL2 and SL3 signifies, during any period intermediate consecutive reset pulses from the source RPS, whether or not the voltage developed across the respective signal lamps L1,L2 and L3 has exceeded a predetermined magnitude in either direction relative to a reference level during that period. In particular, the information present at the respective outputs of the latches SL1,SL2 and SL3 immediately prior to reset of the latches signifies whether or not the voltage developed across the respective signal lamps L1,L2 and L3 has exceeded a predetermined magnitude in either direction relative to the reference level at any time during the cycle of the alternating supply voltage preceding reset.

The outputs of the latches SL1,SL2 and SL3 are each fed to one of the set of input terminals of a conflict detector CD of known kind in the form of a so-called "diode matrix". A "diode matrix" comprises two sets of spaced conductors orthogonal to each other in a cross-bar arrangement, each conductor of one conductor set being connected to a corresponding conductor of the other conductor set and to a corresponding input terminal. The diode matrix is wired to produce conflict indicating information at its output in response to given combinations of input terminals of the input terminal set being simultaneously energized. Such operation is achieved by the previous connection of diodes across appropriate intersecting matrix conductors corresponding with given input selected in accordance with predetermined requirements.

The output of the conflict detector CD is fed via an integrator INT to the set input of a stretch-latch ST. The integrator INT has a discharge time constant of one millisecond. The stretch-latch ST is formed by two of the gates of an integrated circuit type 74HC02 with the two gates interconnected to operate as a latch functioning in a similar manner to the latch SL1. The reset input of the latch ST is connected to the reset pulse source RPS which feeds a reset pulse thereto at the commencement of each cycle of the alternating supply voltage of the source S. Conflict signifying information supplied by the conflict detector CD via the integrator INT to the set input of the latch ST at any time between reset pulses results in the output of the latch ST being activated until at least the occurrence of the next succeeding reset pulse.

The output of the stretch-latch ST is supplied to the input of a conflict protection means CPM which controls the energization of the relay switch SW.

Although its particular form is not an essential part of the present invention, it is necessary for the conflict protection means CPM to be operative so that switch-on of the system of FIG. 2 results in the closure of the contact of the relay switch SW thereby connecting the terminals A and N of the source S across the respective series combinations of the lamps L1, L2 and L3 and associated switch devices SD1, SD2 and SD3. In addition, it is necessary for the conflict protection means CPM to respond to continuous activation of its input for a period of time in excess of a predetermined measurement period in such a manner as to cause the contacts of the relay switch SW to be open-circuited, while being unresponsive to activation of its input for any shorter period of time. Various means are known to persons skilled in the art for providing a conflict protection means having the aforementioned properties. The selection of the duration of the said predetermined measurement period will depend upon the requirements of the conflict monitoring system in question. It is also desirable, in many instances, to provide a conflict protection reset means for resetting the conflict protection means CPM during operation, either manually or by some automatic process, whereby the contacts of the relay switch SW are re-closed subsequent to such open-circuit to determine whether or not a conflict condition still exists. However, the nature of such conflict protection reset means will be a matter of appropriate design for the conflict monitoring system in question. The conflict protection means CPM may take a form basically similar to the conflict protection means described in applicant's copending U.S. patent application Ser. No. 903,043.

Figure 3:
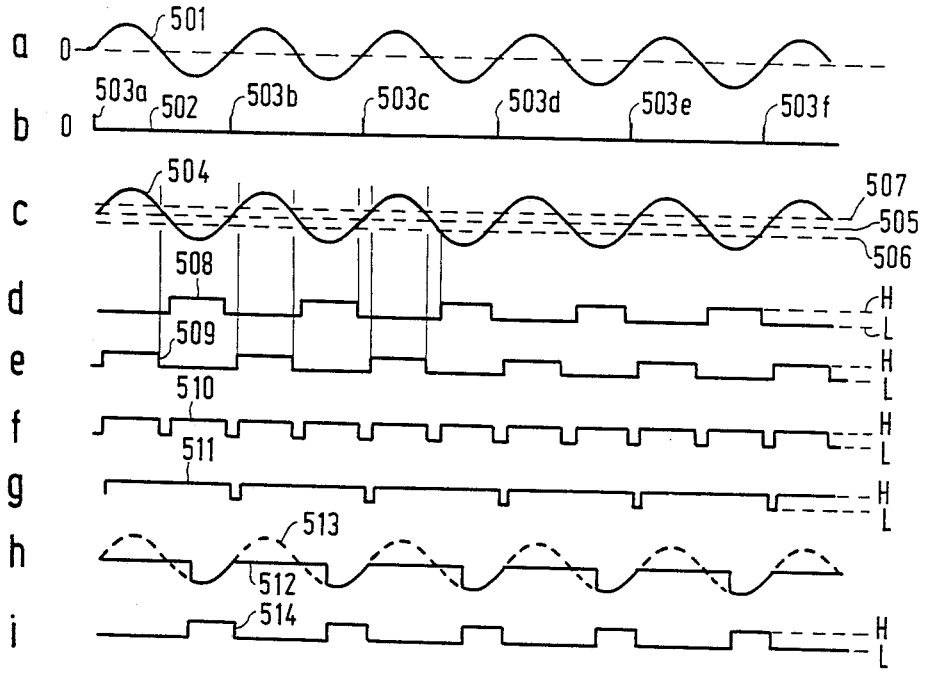
FIGS. 3 and 4 depict a series of wave forms to assist in an understanding of the invention.
Figure 4:
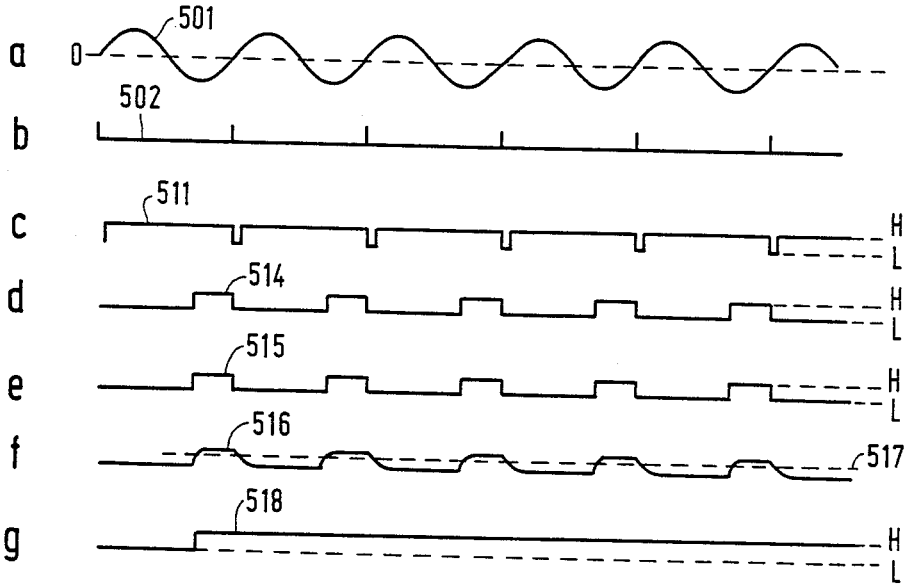

Reference will now be made more particularly to FIGS. 3 and 4 which depict wave forms which may be present at different parts of the circuit arrangements of FIGS. 1 and 2 under operational circumstances. The wave forms depicted in FIGS. 3 and 4 are in the same time relationship with each other.

FIG. 3(*a*) shows a voltage wave 501 corresponding with the voltage difference Va−Vn present between the terminals A and N of the supply source S. The voltage wave 501 has a frequency of 50 cycles per second and an RMS voltage of 240 volts. The wave 501 is substantially of sinusoidal shape.

FIG. 3(*b*) shows a voltage wave 502 corresponding with the pulse train output of the reset pulse generator RPS, each of the reset pulses 503(*a*), 503(*b*), etc. occurring coincident with the negative to positive zero-crossover points of the wave form 501 and each reset pulse having a duration of approximately 30 microseconds.

FIG. 3(*c*) shows a voltage wave 504 corresponding with the voltage developed across the resistance R120 and derived from the voltage developed across the lamp L1 as a result of the switching device SD1 being in a conductive state. The voltage wave 504 is substantially equivalent to the wave 501 but of smaller peak-to-peak magnitude. The dotted line 505 denotes a reference wave in respect of which the reference waves 506 and 507 are equally spaced, the reference wave 506 corresponding with the reference voltage Va and the reference wave 507 corresponding with the reference voltage Vb. It will be appreciated that the output of the differential amplifier 101 is activated each time the wave 504 exceeds the voltage of the wave 507 and that the output of the differential amplifier 102 is activated each time the wave 504 is less than the voltage of the wave 506.

The waveforms of FIG. 3(*d*) are provided for explanatory purposes, and show a voltage wave 508 due to activation of the output of the differential comparator 102 as a result of the wave 504 across the resistance 120 (assuming the comparator 101 to be disconnected) whereas FIG. 3(*e*) shows a voltage wave 509 due to activation of the output of the differential comparator 101 as a result of the wave 504 across the resistance 120 (assuming the comparator 102 to be disconnected).

FIG. 3(*f*) shows a voltage wave 510 corresponding with the voltage produced at the output of the voltage comparator 100 in response to the wave 504 being present across the resistance 120 and is the combination of the waves 508 and 509. The voltage wave 510 is present also at the input of the sensing latch SL1.

FIG. 3(*g*) shows a voltage wave 511 produced at the output of the sensing latch SL1 as a result of the wave 510 being applied at its input. With the occurrence of each reset pulse of the wave 502, the wave 511 drops to a "low" level. Throughout, "high" and "low" levels are denoted by the letters "H" and "L" respectively.

FIG. 3(*h*) shows a voltage wave 512 corresponding with a voltage developed across the resistance 220 at the input of the voltage comparator 200 and derived from a voltage developed across the signal lamp L2 as a result of malfunction of the switching device SD2 under conditions where the latter is intended to be non-conductive but, owing to malfunction, is, in fact, conductive for a portion of each negative-going half-cycle of the supply voltage wave 501. The dotted line 513 corresponds with a voltage which would have been present across the resistance 220 if the device SD2 was conductive during the whole of each cycle of the wave 501.

FIG. 3(*i*) shows a voltage wave 514 produced at the output of the sensing latch SL1 as a result of the wave 512 being applied to the input of the voltage comparator 200.

The voltage present across the signal lamp L2 as a result of the aforementioned malfunction of the switching device SD2 could be of sufficient magnitude for the lamp L2 to be wrongly illuminated simultaneously with intended illumination of the signal lamp L1 as indicated by the wave 514. Such a malfunction results in the output of the sensing latch associated with the lamp concerned to be activated. A malfunction of the switching device SD2 resulting in conduction of the switching device SD2 during a portion only of positive-going half-cycles of the wave 501 would likewise result in activation of the output of the sensing latch SL2. Such activation would commence earlier during each cycle of the wave 501 and would continue until the occurrence of the next succeeding reset pulse.

FIG. 4 shows a series of wave forms on a similar time scale to that of FIG. 3 and associated with operation of the conflict detector CD and the stretch-latch ST of the system of FIG. 2.

FIGS. 4(*a*), 4(*b*), 4(*c*) and 4(*d*) respectively correspond with FIGS. 3(*a*), 3(*b*), 3(*g*) and 3(*i*) and are provided for convenience of reference.

The conflict detector CD of FIG. 2 is wired so as to produce conflict signifying information at its output in the event of simultaneous activation of terminals P1 and P2 of its input terminal set and FIG. 4(*e*) shows a wave 515 corresponding with simultaneous activation of the terminals P1 and P2 as a result of the wave form 511 and the wave form 514 being present at the respective output of the sensing latches SL1 and SL2. Since no voltage is present across the lamp L2 except during portions of the negative-going half-cycles of the wave 501, conflict signifying information is produced at the output of the conflict detector CD for a short period during the latter part only of each cycle. The wave 515 corresponds substantially with the wave 514.

FIG. 4(*f*) shows a wave 516 corresponding with the voltage produced at the input of the stretch-latch ST in response to the wave form 515 being supplied thereto via the integration circuit INT. The dotted line 517 denotes the level of the data input voltage at which the output of the stretch-latch ST is activated. The exponential rise and fall of the leading and trailing edges of the pulses of the wave 516 are determined by the time constants of the integration circuit INT. The discharge time constant of the integration circuit INT should be greater than the duration of the reset pulses (i.e. greater than 30 microseconds) so that application of a reset pulse to the reset input of the stretch-latch ST will not reset the latch ST whenever the latch data input is active upon application of the reset pulse. In this respect, it should be noted that operation of the stretch-latch ST is governed by a truth table corresponding with that of Table 1.

FIG. 4(*g*) shows a wave form 518 corresponding with the output voltage of the stretch-latch ST resulting from application of the wave 516 to its data input. It will be noted that the output of the latch ST is activated as the first occurring pulse of the wave 516 exceeds the level 517 and remains active despite the occurrence of the subsequent reset pulses 502(*b*), 502(*c*), 502(*d*) etc. However, should the conflict condition denoted by the presence of the pulses of the wave 515 cease, then the latch ST will be reset by the next succeeding reset pulse and the wave 518 will return to the "low" level.

The output of the latch ST is applied to the conflict protection means CPM. Accordingly, the conflict protection means CPM will cause the contacts of the relay switch SW to become open-circuited if the output of the stretch-latch ST is continuously activated, as denoted by the "high" portion of the wave 518, for a period exceeding the aforementioned predetermined measurement period.

A monitor circuit arrangement of the kind described in connection with FIG. 1 is able to be designed so that the voltage comparator 100 is sensitive to extremely low voltages developed across the unit being monitored (the lamp L in this instance) for example, voltages having a magnitude as low as 20 volts. Alternatively, by appropriate design of the reference voltage generator RG, the said predetermined magnitude may be of any desired magnitude within a wide range. In this way, the monitor circuit arrangements may be proportioned so that the output of the voltage comparator 100 will be activated only when the voltage developed across the lamp L is relatively high.

Moreover, by employing a plurality of monitor circuit arrangements such as that of FIG. 1, in a monitor system as that exemplified by the system of FIG. 2, there is the important advantage that the system is able to detect the existence of a conflict when two conflicting monitored units (e.g. lamps) are energized under conditions when the respective units are each energized on alternate half-cycles of the supply, respective units being supplied with current in anti-phase with each other so that a voltage is not present across both units simultaneously.

Many variations of the embodiment of the invention described in relation to FIGS. 1 and 2 will be evident to persons skilled in the art. For example, FIG. 2 depicts a system employing three monitor circuit arrangements in accordance with the invention each serving as a monitor path supplying data to the conflict detector CD, whereas a much greater number of monitor paths may be employed for monitoring a correspondingly greater number of energizable units. Also, the conflict detector CD may be replaced by a conflict detector other than in the form of a "diode matrix". For instance, the conflict detector CD may be in the form of an addressable semiconductor memory with the address terminals of the memory serving as the set of input terminals of the conflict detector. These and other variations to the embodiment described herein are intended to be included within the scope of the present invention.

Circuit arrangements in accordance with the present invention may be employed advantageously when forming part of a monitoring system of the kind described in the applicant's copending U.S. patent application Ser. No. 903,043 wherein a plurality of monitor paths each supply data to a conflict detector.

What is claimed is:

1. A monitor circuit arrangement comprising: input terminals for connection to an alternating voltage supply source for supplying energy to an energizable unit via a controlled switching device, means for monitoring energization of the unit including a voltage comparator connected in cascade with a sensing latch, the voltage comparator being activated at its output in response to its input voltage exceeding a predetermined magnitude of either polarity relative to a common reference voltage wave, means for supplying a monitored voltage representative of the voltage present across the energizable unit as an input voltage to the voltage comparator, the output of the comparator being fed to the sensing latch set input, and reset means coupled to a reset input of the sensing latch for resetting the latch at the commencement of each cycle of the alternating supply voltage.

2. A monitor circuit arrangement as claimed in claim 1, wherein said common reference voltage wave comprises an alternating voltage derived from the alternating voltage supply source.

3. A monitor circuit arrangement as claimed in claim 1, wherein said energizable unit and said controlled switching device are connected in series across output terminals of said alternating voltage supply source.

4. A monitor circuit arrangement as claimed in claim 1, wherein said voltage comparator comprises first and second comparator units each having first and second inputs and with a first input of the first comparator unit connected to the first input of the second comparator unit and to the energizable unit to receive said monitored voltage, and wherein the second inputs of the first and second comparator units receive individual alternating reference voltages of opposed phase so as to establish positive and negative polarity excursion limits of the monitored voltage for activating the voltage comparator.

5. A monitor circuit arrangement as claimed in claim 1 wherein the said common reference voltage wave comprises a first alternating reference voltage having a magnitude proportional in a given ratio to the magnitude of the supply source voltage, and wherein the said monitored voltage is a derived voltage having a magnitude proportional in a similar given ratio to that of the voltage difference between the supply source voltage and the voltage across the energizable unit.

6. A monitor circuit arrangement as claimed in claim 5 wherein the said voltage comparator comprises first and second differential comparators in combination, the output of the two differential comparators being connected to function as the voltage comparator output, a positive input of the first differential comparator being connected to a second reference source supplying a second reference voltage of a said predetermined magnitude, the negative input of the second differential comparator being connected to a third reference source supplying a third reference voltage less than the said first alternating reference voltage by the said predetermined magnitude, and a negative input of the first differential comparator being connected to the positive input of the second differential comparator to form the voltage comparator input.

7. A monitor system comprising a conflict detection means provided with a set of input terminals respectively connected via individual monitor paths to monitor individual energizable units or groups of energizable units so that respective input terminals of the set are activated in response to energization of respective individual units and or groups of units, individual monitor paths including a monitor circuit arrangement as claimed in claim 1 the conflict detection means generating conflict signifying information at an output thereof in response to simultaneous activation of predetermined combinations of input terminals of the set.

8. A monitor system as claimed in claim 7 wherein the said conflict detection means is followed by an information processing stage which processes conflict signifying information produced at the conflict detection means output whereby the information so processed is substantially free of interruptions arising from reset of the sensing latches.

9. A monitor system as claimed in claim 8 wherein the said information processing stage comprises a network including a series resistance and a parallel capacitance, the network having a large time constant relative to the duration of interruptions in conflict signifying information due to reset of said sensing latches.

10. A monitor system as claimed in claim 8 wherein the said information processing stage comprises a further latch in combination with an integrating network, the output of the said conflict detection means being supplied to a set input of the further latch via the integrating network, the reset input of a further latch being activated at the commencement of each cycle of the supply source by a reset pulse and the time constant of the integrating network being long relative to the duration of the reset pulse whereby the further latch is only reset by a reset pulse if no conflict signifying information is present at its input at the time of the reset pulse.

11. A monitor system as claimed in claim 8 wherein the said information processing stage comprises a resettable further latch having a data input connected to the said conflict detection means output and which is reset synchronously but not simultaneously with reset of the said sensing latches.

12. A monitor circuit for at least one energizable load unit comprising: a pair of input terminals for connection to a source of AC supply voltage, a semiconductor controlled switching device having a control electrode coupled to a control circuit, means for connecting said switching device and a load unit in series circuit across said input terminals, a voltage comparator having an input coupled to the load unit and operative to produce an output signal when a voltage at its input, which input voltage represents the monitored voltage at the load unit, exceeds a predetermined magnitude of either positive or negative polarity relative to a common reference voltage, a sensing latch having a set input coupled to receive said comparator output signal, a reset input and an output coupled to an output of the monitor circuit for indicating a malfunction in the energization of the load unit, and means responsive to said AC supply voltage and coupled to said reset input of the sensing latch for resetting the sensing latch at the start of each cycle of the AC supply voltage.

13. A monitor circuit as claimed in claim 12 wherein said common reference voltage comprises an alternating reference voltage derived from the AC supply voltage.

14. A monitor circuit as claimed in claim 12 wherein said common reference voltage comprises a first alternating reference voltage derived from the AC supply voltage, said voltage comparator comprising a combination of first and second differential comparators having their outputs coupled to said set input of the sensing latch to supply thereto said output signal, means connecting a non-inverting input of the first comparator to a second source of alternating reference voltage and an inverting input of the second comparator to a third source of alternating reference voltage, and means connecting an inverting input of the first comparator to a non-inverting input of the second comparator to form said voltage comparator input.

15. A monitor circuit as claimed in claim 12 wherein said resetting means generates reset voltage pulses at the start of each cycle of the AC supply voltage.

16. A monitor circuit as claimed in claim 12 wherein the voltage comparator and the resetting means operate independently of said control circuit.

17. A system for monitoring at least two energizable load units comprising first and second monitor circuits each as claimed in claim 12 and coupled to said input terminals, wherein the output of the sensing latch of each monitor circuit is coupled to an input of a conflict detection means coupled in turn via an integrator to a control output of the monitoring system.

18. A monitoring system as claimed in claim 17 wherein each of said energizable load units comprises a lamp of a traffic control system.

* * * * *